United States Patent [19]

Drozd, Jr.

[11] Patent Number: 4,489,843

[45] Date of Patent: Dec. 25, 1984

[54] TAMPER-EVIDENT CLOSURE AND CONTAINER

[75] Inventor: Edward J. Drozd, Jr., Lake Hiawatha, N.J.

[73] Assignee: Captive Plastics, Inc., Piscataway, N.J.

[21] Appl. No.: 476,147

[22] Filed: Mar. 17, 1983

[51] Int. Cl.[3] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 2,423,582 | 7/1947 | Coleman | 215/252 |
| 3,455,478 | 7/1969 | Fields et al. | 215/252 |
| 3,504,818 | 4/1970 | Crisci et al. | 215/252 |
| 3,901,403 | 8/1975 | Menke | 215/258 X |
| 3,980,195 | 9/1976 | Fillmore | 215/252 X |
| 4,352,436 | 10/1982 | Chartier et al. | 215/252 |

FOREIGN PATENT DOCUMENTS

| | | | |
|---|---|---|---|
| 2229620 | 12/1974 | France | 215/252 |
| 2,310,932 | 12/1976 | France | 215/252 |

*Primary Examiner*—Donald F. Norton

*Attorney, Agent, or Firm*—Caesar, Rivise, Bernstein & Cohen

[57] ABSTRACT

Tamper-evident closures include a threaded cap and a tamper-evident ring removably connected to each other by break-away tabs adapted to break when the cap is rotated in a direction to remove it from a cooperating container. The cap and ring have cooperating surfaces for transmitting closing rotational movement of the cap to the ring to thereby rotate the cap and ring together during closing of the container to thereby prevent separation of the cap from the ring at the break-away tabs. The ring further includes at least one locking surface adapted to engage a corresponding surface on a container to prevent the ring from rotating in the opening direction of rotation, whereby rotation of the closure to open it will cause relative movement between the cap and ring to sever the break-away tabs. A method of molding the cap, tamper-evident ring and break-away tabs as a single member also constitutes a part of the invention, as well as the particular container constructions adapted to cooperate with the closures.

20 Claims, 10 Drawing Figures

TAMPER-EVIDENT CLOSURE AND CONTAINER

FIELD OF THE INVENTION

This invention relates generally to tamper-evident closures, and more specifically to tamper-evident closures of the type employing a tamper-evident ring connected to a cap by break-away tabs. The invention also resides in a method of forming the closures, and in containers utilizable with said closures.

BACKGROUND ART

Tamper-evident closures of the type employing an annular tamper-evident ring interconnected to a threaded cap through break-away tabs are well known in the art. For example, in the bottling of soda pop it is common to actually roll a stamped metal member onto the threaded neck of a bottle to form a closure therefor. The lower edge of the closure can be wrapped under a peripheral rim associated with the neck of the bottle, and a plurality of spaced-apart cuts can be formed about the periphery of the closure, in an area below the bottle threads and above the rim, to define spaced-apart tabs that divide the closure into an upper cap and lower tamper-evident ring.

Rolled metal closures of the type described above often have proven unreliable in operation. In fact, almost anyone who purchases soda on a regular basis encounters bottles in which the tabs interconnecting the cap to the tamper-evident ring do not separate when the cap is turned to open it. When this occurs, the lower in-turned edge of the cap that is wrapped under the rim on the bottle can actually prevent physical separation of the cap from the bottle, unless either the in-turned edge is pried away from the rim, or the tabs are manually cut with a knife or other instrument. Moreover, if the cap is removed without separation of the tamper-evident ring, the closure can be reattached to the bottle without providing any visible indication that the bottle was ever opened. This completely defeats the intended reason for providing the tamper-evident ring.

It also is known in the art to mold a closure having a threaded plastic cap with an annular tamper-evident ring integral therewith, the ring being interconnected to the threaded cap through a series of break-away tabs spaced about the entire periphery of the closure. The tamper-evident ring is molded below the threaded cap, either coaxial with the cap or slightly offset in a lateral direction. In either case, the tamper-evident ring is intended to be spaced-apart from the lower surface of the cap, and retained in proper position relative to said cap solely by the break-away tabs. In order to maintain the closure in a functional condition, these break-away tabs need to be able to withstand the vertical and rotational forces imposed upon them, without breaking, as the closure is being secured to a container. This generally necessitates very careful handling of the closure in special capping equipment. Stating this another way, the sole support for the tamper-evident ring is the interconnecting tabs, which, if properly formed, do not provide a great deal of interconnecting strength. Therefore, these tabs may not be able to withstand the forces imposed upon them in conventional capping equipment; thus necessitating the use of special capping equipment.

It is not uncommon in the formation of the above-described plastic, tamper-evident closures to experience flashing in the molding operation. If this occurs, plastic bridges can be formed between the break-away tabs to thereby form an excessively strong bridge between the cap and ring, and thereby prevent easy separation of the ring from the cap as the cap is being rotated to open the container. This can either prevent easy removable of the cap from the container, or can cause separation of the cap and ring as a single unit. In the latter case there will be no visible indication that the container had been opened once the closure is reattached to the container.

In all of the above-described systems, a plurality of break-away tabs are provided about the entire outer periphery of the closure to interconnect a threaded cap member to a tamper-evident ring. This sometimes provides a very strong interconnection which imposes a great deal of resistance to the separation of the cap from the ring. In these cases it virtually is impossible for individuals inflicted with arthritis of the hands, or similar debilitating conditions, from being able to remove the closure.

The present invention is intended to overcome the above-described deficiencies encountered in the prior art systems.

DISCLOSURE OF INVENTION

A tamper-evident closure of this invention includes a threaded cap and a tamper-evident ring interconnected through break-away tabs that are adapted to break when the cap is rotated to remove it from a container; the improvement including cooperating surface means, independent of the break-away tabs, associated with the cap and ring for causing said ring and cap to rotate together in the closing direction of rotation of the closure to thereby prevent separation of the ring and cap at the break-away tabs when the closure is being threaded onto the container.

By providing the cooperating surface means between the cap and ring, as described above, the break-away tabs are not required to actually withstand the brunt of the shearing, or rotational forces that they otherwise would encounter when the closure is being secured to a container. This permits the use of significantly weaker tab connections than previously have been utilized, and in fact, in the preferred embodiments of the invention the tabs are disposed only about a small segment of the periphery of the closure. Most preferably, the tabs are disposed about a segment of the periphery constituting less than about 45 degrees, and most preferably less than 20 degrees.

In accordance with the preferred method of forming the closure the tamper-evident ring and threaded cap are molded as a single-unit, in side-by-side relationship, with the break-away tabs interconnecting them. These tabs, preferably two in number, constitute hinges about which the ring and cap can be moved into overlying relationship with each other to form the completed closure. To retain the tamper-evident ring in proper orientation relative to the closure, a retaining lug, preferably an integral part of the ring, is provided with a downwardly directly surface for engaging an upper surface of a shelf formed integrally with the cap. The retaining lug preferably is substantially diametrically opposed to the break-away tabs, thereby providing balanced, or symmetrical attachment of the ring to the cap. The cap also includes a driving surface facing generally in the closing direction of rotation of the cap for cooperating with a side surface of the retaining lug to provide a torque-transmitting interconnection between the cap and ring that permits them to rotate as a single unit as the closure is being secured to the container.

By virtue of the above construction the confronting substantially annular surfaces of the cap and ring are in substantial engagement with each other, and therefore, the interconnecting break-away tabs do not need to be so strong as to be able to withstand the compressive loading between the ring and cap as the closure is being secured to a container. These compressive forces are transmitted through the confronting surfaces; not the tabs. In view of this arrangement, it is believed that more conventional capping equipment can be employed with the closures of this invention than can be employed with the prior art molded closures wherein the break-away tabs actually space the ring from the cap. In the prior art closures the tabs are exposed to and actually are required to transmit the full compressive load between the cap and ring created by the capping operation. Moreover, in the present invention the break-away tabs do not need to be as strong as in the prior art constructions, since they are not being relied upon to take up the compressive loading. Since they can be made weaker, less force will be required to break them when the closure is opened for the first time, and this makes for a more reliable, easier-to-use system.

In the preferred embodiment of this invention at least one locking lug is provided on the interior, annular surface of the tamper-evident ring, and this lug includes a locking surface facing in the opening direction of rotation of the closure. More preferably, at least two such locking lugs are provided, and both are intended to cooperate with locking surfaces formed about the periphery of a threaded container, and facing substantially in the closing direction of rotation of the closure. The cooperating locking surfaces of the ring and container prevent the tamper-evident ring from rotating in the opening direction of rotation, and thereby cause the ring and cap to separate at the break-away tabs as the cap is rotated to open the container. This causes the ring to fall away from the cap; thereby indicating that the container has been opened.

In the most preferred embodiment of this invention the tamper-evident ring also is provided with an inwardly directed shoulder, or bead extending circumferentially about a substantial portion of the ring; preferably about 270 degrees or more. This shoulder is adapted to snap over a cooperating shoulder, or bead formed on the threaded neck of the container to which the closure is to be attached. This arrangement prevents the ring from falling off the container after it has been separated from the cap. In other words, once the cap has been opened and the tamper-evident ring separated therefrom at the break-away tabs, it will be captively retained on the container so as to make it abundantly clear to an observer that the package had been opened.

Other objects and advantages of this invention will become apparent by referring to the description of the Best Mode of the Invention which follows, taken in conjunction with the drawings.

BEST MODE OF THE INVENTION

Figure 1:
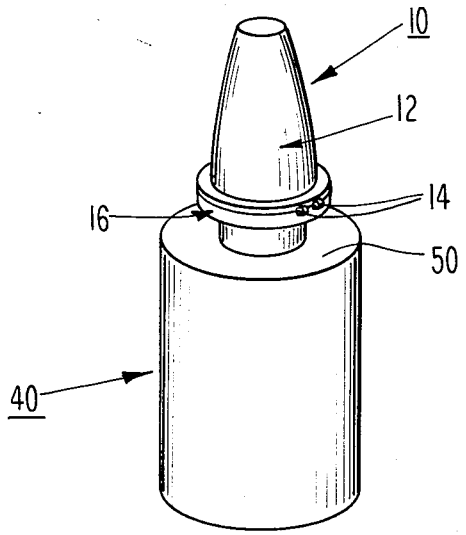
FIG. 1 is an isometric view of a closed package, with the tamper-evident closure intact; i.e. prior to opening the package for the first time.

Referring to FIG. 1, a tamper-evident closure 10 of this invention includes a threaded cap 12 interconnected by a pair of break-away tabs 14 to a tamper-evident ring 16.

Figure 4:
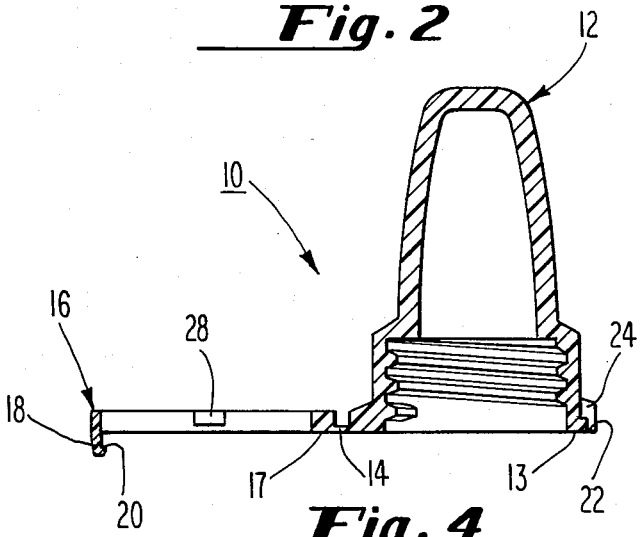
FIG. 4 is a longitudinal sectional view through a tamper-evident closure in accordance with this invention, showing the arrangement of elements as they initially are molded.
Figure 5:
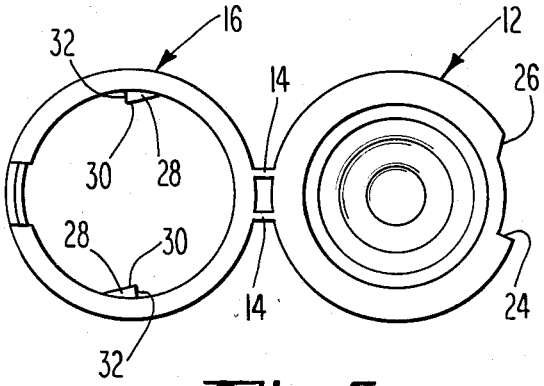
FIG. 5 is a bottom view of the closure shown in FIG. 4.

Referring specifically to FIGS. 4 and 5, the tamper-evident closure 10 is molded as a single unit with the tamper-evident ring 16 and threaded cap 12 in side-by-side relationship. The break-away tabs 14, in addition to separating, or shearing for the purpose of indicating that the closure 10 has been opened, also function as hinge members to permit the cap 12 and ring 16 to be moved relative to each other into coaxial alignment, as is clearly shown in FIG. 1. In other words, the ring 16 can be moved into underlying relationship with the cap 12 about the break-away tabs 14 to make the closure operable.

Figure 3:
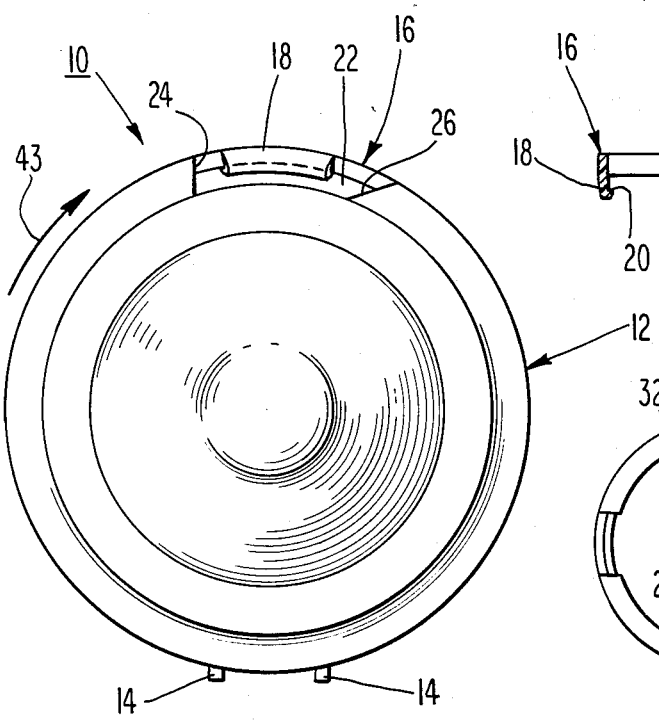
FIG. 3 is an enlarged plan view of FIG. 1.

Referring specifically to FIGS. 3–5, a retaining lug 18, forming part of the tamper-evident ring 16, is employed to retain the ring in its operative position underlying the cap 12. In its operative orientation the retaining lug 18 includes an inwardly directed, downwardly facing surface 20 which is adapted to snap into overlying relationship with the upper surface of a shelf 22 that is an integral part of the threaded cap 12. In this condition the lower surface 13 of the cap 12 and the confronting, or adjacent surface 17 of the ring 16 are in substantial contact with each other; the hinged connection provided by the break-away tabs 14 being disposed generally outside these contacting surfaces. As explained earlier, this arrangement makes it unnecessary to design the break-away tabs 14 with sufficient strength to withstand the imposition of the compressive forces imposed upon the closure 10 as it is being secured to a cooperating container. In other words, these compressive forces do not need to be taken up, or carried by the break-away tabs 14. Rather they are transmitted through the confronting surfaces of the closure and ring.

As can be seen best in FIGS. 3 and 5, the shelf 22, upon which the downwardly facing surface 20 of retaining lug 18 sits, is bounded on opposite sides by a driving surface 24 and an inclined, camming surface 26, respectively. The driving surface 24 faces generally in the closing direction of rotation of the closure, as is illustrated by arrow 43, whereas the camming surface faces generally in the opening direction of rotation. The manner in which the driving and camming surfaces 24 and 26 cooperate with the remainder of the closure 10 to assist in both the closing and opening operations will be described later in this application.

Referring specifically to FIGS. 4 and 5, the tamper-evident ring 16 includes substantially diametrically opposed locking lugs 28 formed by inclined camming surfaces 30 that terminate in locking surfaces 32. The locking surfaces 32 face substantially in the opening direction of rotation of the closure, and are adapted to cooperate with corresponding, but oppositely facing surfaces of locking ribs 44 provided on the container of this invention, as will now be described.

Figure 6:
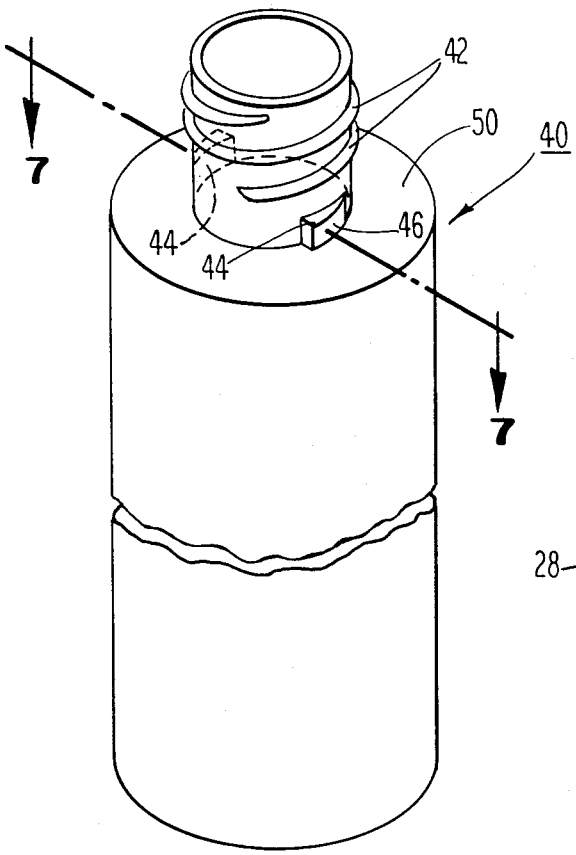
FIG. 6 is a fragmentary isometric view of a container showing the unique top thereof, said top being adapted for use with the tamper-evident closure illustrated in FIGS. 4 and 5.
Figure 7:
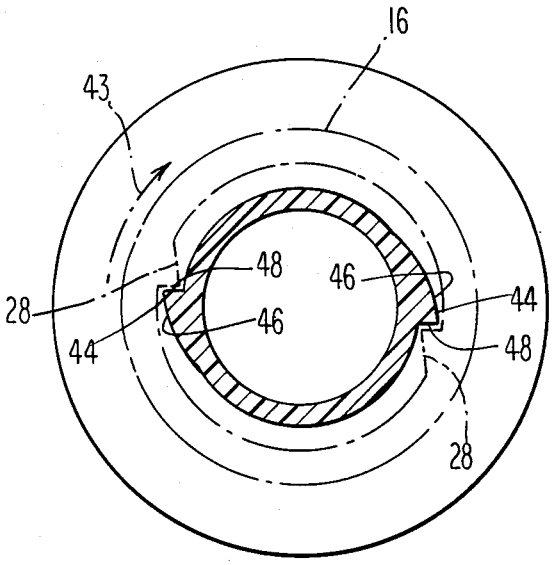
FIG. 7 is a sectional view along line 7—7 of FIG. 6, showing in phantom representation the manner in which the tamper-evident ring of the closure cooperates with the container top construction when the closure is sealing the container.

Turning specifically to FIGS. 6 and 7, the unique container 40 of this invention includes a neck having conventional threads 42 for cooperating with conventional threads of the cap 12. In the illustrated embodiment the closing direction of rotation is in the direction of arrow 43 (clockwise as illustrated in FIGS. 3 and 7).

Figure 2:
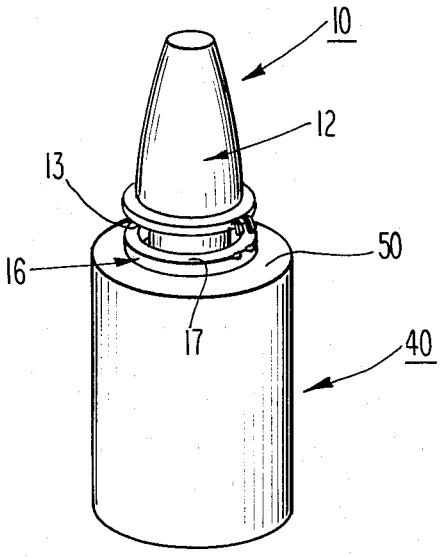
FIG. 2 is an isometric view similar to FIG. 1, but showing the arrangement of elements of the closure after it initially has been opened.

The threads 42 are located about the neck of the container 40, and at the base of the neck, below these threads, unique locking ribs 44 are provided. In the illustrated embodiment two of such ribs are provided, and are substantially diametrically opposed to each other. These ribs have camming surfaces 46 which are substantially convex in transverse section (FIG. 7), and which terminate at the outer marginal edges of respective locking surfaces 48 that face generally in the direction of closing rotation of closure 10. The ribs 44 also extend vertically upwardly from a shoulder 50 of the container; said shoulder being adapted to receive, and actually support the tamper-evident ring 16 after it has been separated from the threaded cap 12 (FIG. 2). As can be seen best in FIG. 7, when the closure 10 is firmly secured to the container 40, the locking lugs 28 overlie the locking surfaces 48 of the ribs 44. The cooperating arrangement between the camming surfaces 30 and 46 permits the locking lugs 28 associated with the ring 16 to flex outwardly, and snap into overlying relationship with the locking ribs 44 as the closure 10 is tightened onto said container.

It is not critical that the locking surfaces 32 and 48 be in contact with each other when the closure 10 is completely closed. Preferably, these confronting surfaces are no more than 30 degrees from each other, and most preferably no more than about 10 to 15 degrees from each other. The important criteria that needs to be met is that the cooperating surfaces 32 and 48 be located so as to engage, or interface with each other as the closure 10 is moved in its opening direction of rotation. If these surfaces are angularly too far apart, the relative vertical movement that takes place between closure 10 and the container 40 as the closure is being opened may cause the locking lugs 28 to actually move vertically over the locking ribs 44; thereby preventing the desired interference from taking place between the cooperating surfaces 32 and 48. As long as the lugs 28 and ribs 44 are located close enough to prevent this from happening, the device will be operable, in the manner now to be described.

The closure 10 initially is secured to the container 40 by rotating it in the general direction or rotation indicated by arrow 43 in FIGS. 3 and 7. As the cap is being rotated, the driving surface 24, constituting an integral part of the threaded cap 12, will engage a side surface of the retaining lug 18, constituting an integral part of the tamper-evident ring 16. In this manner the rotational forces imparted, or imposed upon the threaded cap 12 will be transmitted to the ring 16, and thereby prevent shearing, or separation at the break-away tabs 14. As the closure 10 is rotated to close it, the camming surfaces 30 of locking lugs 28 will ride over corresponding camming surfaces 46 of the locking ribs 48, and thereafter snap into a position similar to that illustrated in FIG. 7.

When the closure 10 is opened for the first time (either for its intended use, or because of undesired tampering), the locking surfaces 32 formed on the interior of the tamper-evident ring 16 initially will be moved into engagement with the locking surfaces 48 formed on the neck of the container 40 to thereby prevent further relative rotational movement between said ring and container. Thereafter, continued rotational movement of the threaded cap 12 will cause it to separate from the ring 16 by the shearing of break-away tabs 14. When this occurs, the ring 16 will drop away from the cap, and be supported upon the shoulder 50 of the container, as is illustrated best in FIG. 2.

The arrangement described thus far provides a clear visible indicator that the package has been opened. However, unless there is some means for physically retaining the tamper-evident ring on the container, it is possible for the ring to fall off, or be very easily removed from the container after the closure has been opened. If that occurred it would not be readily apparent that the package actually had been opened. In other words, it would require closer inspection to notice that a tamper-evident ring has been separated from the closure 10. In fact, unless the individual using the package knew that such a tamper-evident ring previously existed, it might not be apparent to him (or her) that the package previously had been opened.

Figure 9:
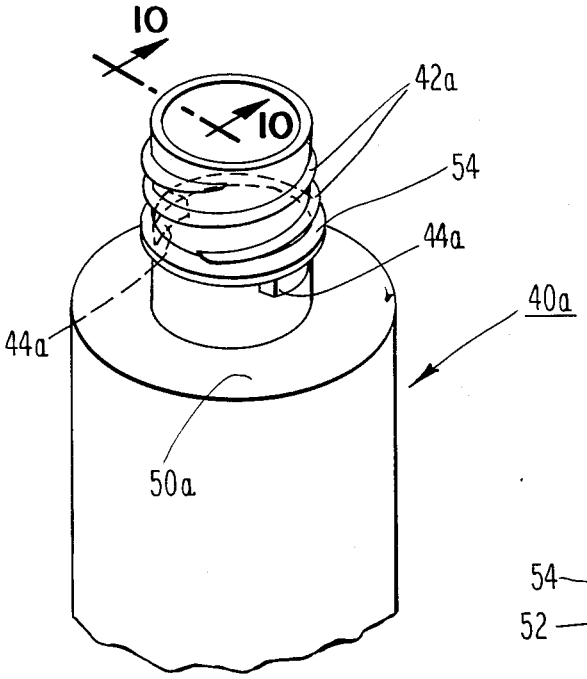
FIG. 9 is a fragmentary isometric view of a modified container top adapted for use with closures employing the modified tamper-evident ring illustrated in FIG. 8.
Figure 10:
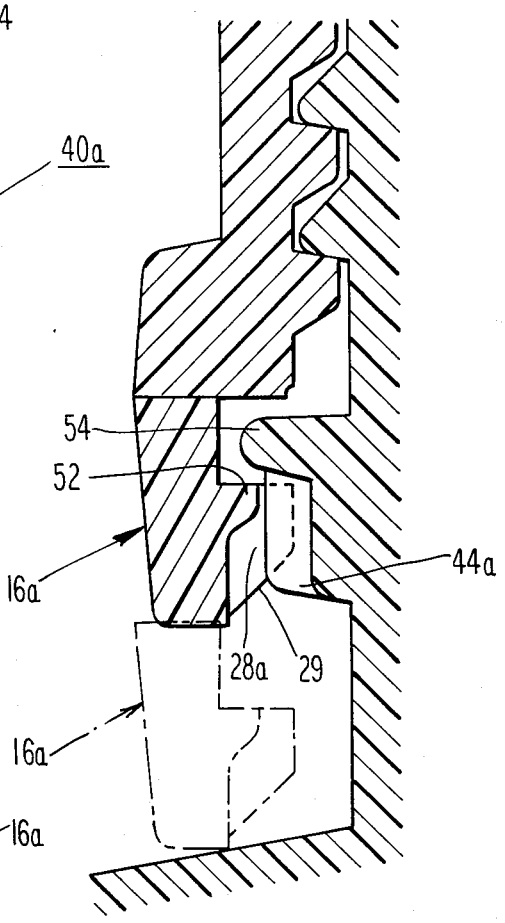
FIG. 10 is a sectional view along line 10—10 of FIG. 9 showing the manner in which the tamper-evident ring of the closure illustrated in FIG. 8 cooperates with the container top construction when the closure is sealing the container, and showing in phantom representation the location of the ring after it has been separated.
Figure 8:
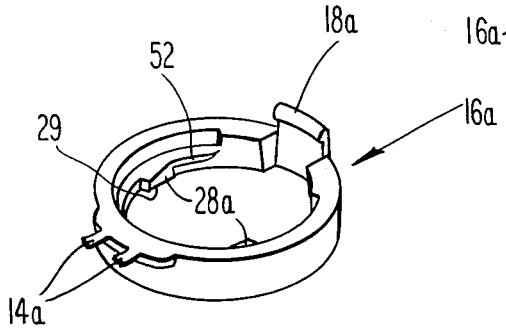
FIG. 8 is an isometric view of a modified tamper-evident ring employed in tamper-evident closures of this invention and constitutes the most preferred form of the invention.

The most preferred embodiment, or best mode of the invention for retaining the tamper-evident ring on the container after it has been separated from the closure is illustrated in FIGS. 8–10, and embodies the invention of Michael Lutz, as will be explained in greater detail hereinafter.

Referring first to FIG. 8, a modified tamper-evident ring 16*a* is provided with a circumferential bead or rib 52 preferably extending continuously more than 180 degrees around the inner periphery thereof, and most preferably approximately 270 degrees; being omitted from the region of the ring occupied by the retaining lug 18*a*. The important criteria is that the bead 52 be capable of retaining the ring on the container after its separation from the closure.

The retaining lug 18*a* and break-away tabs 14*a* can be identical to the corresponding elements of tamper-evident ring 16. The locking lugs 28*a* form continuous extensions of the rib 52 and have upper surfaces substantially coplanar with the upper surface of said rib. Moreover, the locking lugs 28*a* extend downwardly from the rib, as is shown in FIGS. 8 and 9. The bottom of each rib is an inclined camming surface 29; one being illustrated in FIGS. 8 and 10. The function of these camming surfaces will be explained later. The threaded cap employed in this embodiment of the invention can be identical to threaded cap 12.

Referring specifically to FIG. 9, a modified container 40*a*, intended to receive the closure employing the modified tamper-evident ring 16*a*, includes locking ribs 44*a* that are substantially identical in construction to previously described locking ribs 44. However, in this embodiment the neck of the container 40*a* also includes a continuous circumferential rib, or bead 54 located above the locking ribs 44*a* , and beneath conventional threads 42*a*.

Referring to FIG. 10, when the closure is rotated in a clockwise direction to secure it to the container 40*a*, the circumferential bead 52 and locking lugs 28*a* forming part of the interior surface of the ring 16*a*, will move over, and snap into underlying relationship with the circumferential bead 54 on the neck of the container 40*a*. The provision of the camming surfaces 29 on the locking lugs 28*a* facilitates this movement. In this condition the locking lugs 28*a* of the ring 16*a*, in addition to underlying the bead 52, will cooperate with the locking ribs 44*a* on the container 40*a* in the identical manner described earlier in connection with the first embodiment of this invention.

In the embodiment illustrated in FIGS. 8 through 10, when the closure is opened to separate the ring 16*a* from its threaded cap, the ring will drop down, and be supported on the shoulder 50*a* of the container 40*a* in the identical manner described above in connection with the first embodiment of the invention. In addition, the outwardly directed circumferential bead 54 on the neck of the container 40*a* will overlie the bead 52 and locking lugs 28*a* of the ring 16*a* to thereby prevent separation of said ring from the container. Moreover, since both the bead 52 and locking lugs 28*a* are disposed beneath the circumferential bead 54 of the container 40*a* , the ring will not "hang-up" on the bead 54 when it is separated from its attached cap member. This permits the ring 16*a* to drop onto the shoulder and thereby clearly indicate that the package has been opened.

Prior to the inventive contribution of Michael Lutz the tamper-evident ring did hang-up on the container bead. Specifically, the embodiment of the retaining ring prior to Michael Lutz's contribution included the locking lugs positioned above, and being spaced from the bead. Likewise, the locking lugs on the container were positioned above the circumferential bead on the container, and this circumferential bead engaged within the space between the locking lugs and bead of the retaining ring when the closure was closed. When the closure was opened to separate the ring from its threaded cap, the ring was retained on the container by virtue of the circumferential bead of the container overlying the bead on the retaining ring. However the locking lugs on the retaining ring engaged the upper surface of the circumferential bead on the container to prevent the ring from dropping onto the shoulder of the container. Although the embodiment described in this paragraph clearly is operable, the best mode of carrying out the invention embodies the inventive contribution of Michael Lutz; namely, repositioning the locking lugs on the retaining ring to extend below the bead thereon, and making a corresponding adjustment in the relative position between the locking lugs and circumferential bead on the container.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A tamper-evident closure including:

(a) a threaded cap;

(b) a tamper-evident ring;

(c) break-away tab means removably attaching the ring to the cap and adapted to break when the closure is rotated in a direction to remove the cap from a cooperating container; and (d) cooperating surface means on said cap and ring, independent of the break-away tab means, for transmitting closing rotational movement from the cap to the ring to thereby cause said cap and ring to rotate together in the closing direction of rotation of said closure, and thereby prevent separation of the ring from the cap at the break-away tabs when the closure initially is secured to the container.

2. The tamper-evident closure of claim 1 including at least one locking lug on an interior surface of said ring, said at least one locking lug being provided with a locking surface facing in the opening direction of rotation of said closure.

3. The tamper-evident closure of claim 2 including at least a pair of locking lugs substantially diametrically opposed to each other, each locking lug of said pair including a locking surface facing in the opening direction of rotation of said closure.

4. The tamper-evident closure of claim 2 in combination with a container having a threaded neck for receiving the threaded cap, said container including at least one locking rib providing a locking surface facing substantially in the closing direction of rotation of said closure for engaging the locking surface of said at least one locking lug on the ring when the closure is rotated in the opening direction of rotation to thereby prevent rotation of said ring relative to said container for causing said ring to separate from the cap at the break-away tabs.

5. The combination of claim 4 wherein the locking lugs on said ring and the locking ribs on said container include cooperating camming surfaces for permitting movement of the locking lugs over said locking ribs as said closure initially is being applied to said container to thereby permit the locking surfaces of said lugs and ribs to cooperate with each other for impeding rotation of the ring relative to the container when the closure is rotated in its opening direction of rotation.

6. The tamper-evident closure of claim 2 wherein said ring includes an internal, inwardly directed peripheral bead means adapted to move over a cooperating bead means on a container for retaining the ring on said container after it has been separated from the cap.

7. The tamper-evident closure of claim 6 wherein said internal, inwardly directed peripheral bead means extends circumferentially about more than 180 degrees of the tamper-evident ring.

8. The tamper-evident closure of claim 7 wherein said break-away tab means includes only two tabs positioned closely to each other.

9. The tamper-evident closure of claim 6 in combination with a container having a threaded neck for receiving the closure, said container including at least one locking rib beneath the threads of the neck, said locking rib including a locking surface facing substantially in the closing direction of rotation of the closure for engaging the locking surface on said at least one locking lug of the tamper-evident ring when the closure is rotated in the opening direction of rotation; said container further including a peripheral bead means about the neck thereof for overlying the peripheral bead means of the tamper-evident ring for aiding in rotating said tamper-evident ring on the container after separation of said ring from its attached cap at the break-away tabs, the cooperation of the locking surfaces on the container and ring preventing rotation of said ring relative to said container when said cap is rotated in its opening direction to thereby cause said ring and cap to separate from each other at the break-away tabs.

10. The tamper-evident closure of claim 1 wherein said break-away tab means is disposed about only a small segment of the periphery of said closure.

11. The tamper-evident closure of claim 10 wherein said break-away tab means constitutes hinge means for permitting relative movement between the tamper-evident ring and the threaded cap.

12. The tamper-evident closure of claim 11 including at least one locking lug on an interior surface of the ring, said at least one locking lug being provided with a locking surface facing in the opening direction of rotation of said closure.

13. The tamper-evident closure of claim 11 wherein said break-away means includes only two tabs positioned sufficiently close to each other to permit them to function as hinge means.

14. The tamper-evident closure of claim 1 wherein said tamper-evident ring includes a retaining lug having a surface overlying, and cooperating with an adjacent surface of a shelf that constitutes an integral part of the cap.

15. The tamper-evident closure of claim 14 wherein said cap further includes a driving surface facing in the closing direction of rotation of the closure and overlying a side surface of the retaining lug, said driving surface and side surface constituting said cooperating surface means for transmitting closing rotational movement from the cap to the ring to rotate said cap and ring together.

16. The tamper-evident closure of claim 15 wherein said cap further includes a camming surface facing generally in the opening direction of rotation of said closure and overlying the side surface of the retaining lug opposite that engaged by the driving surface for permitting relative rotational movement between said ring and cap when the closure is moved in its opening direction of rotation.

17. The tamper-evident closure of claim 1 wherein said cap and said ring are molded as a single unit in side-by-side relationship to each other and being interconnected by said break-away tab means, said break-away tab means constituting hinge means for permitting said ring and cap to be moved relative to each other into substantially vertical alignment with each other to render the tamper-evident closure ready for use.

18. The tamper-evident closure of claim 17 wherein confronting surfaces of said cap and ring are in substantial engagement with each other when said cap and ring are in substantially vertical alignment with each other.

19. A tamper-evident closure of claim 1 wherein said break-away tab means is disposed only about a segment of the periphery of said closure constituting less than about 45°.

20. A tamper-evident closure including:

(a) a threaded cap;

(b) a tamper-evident ring;

(c) break-away tab means removably attaching the ring to the cap and adapted to break when the closure is rotated in a direction to remove the cap from a cooperating container, said break-away tab means being disposed only about a segment of the periphery of the closure constituting less than about 45°; and (d) cooperating surface means on said cap and ring for transmitting closing rotational movement from the cap to the ring to thereby cause said cap and ring to rotate together in the closing direction of rotation of said closure, and thereby prevent separation of the ring from the cap at the break-away tabs when the closure is initially secured to the container.

* * * * *